US006466204B1

(12) United States Patent
Oh

(10) Patent No.: US 6,466,204 B1
(45) Date of Patent: Oct. 15, 2002

(54) COLOR LCD INTERFACE CIRCUIT IN A PORTABLE RADIO TERMINAL

(75) Inventor: Jeong-Seok Oh, Yongin-shi (KR)

(73) Assignee: Samsung Electronics, Co., Ltd. (KR)

( * ) Notice: Subject to any disclaimer, the term of this patent is extended or adjusted under 35 U.S.C. 154(b) by 0 days.

(21) Appl. No.: 09/482,506

(22) Filed: Jan. 13, 2000

(30) Foreign Application Priority Data

Jan. 13, 1999 (KR) ..... 99-663

(51) Int. Cl.[7] ..... G09G 5/00
(52) U.S. Cl. ..... 345/213; 455/556; 379/88.17
(58) Field of Search ..... 345/213, 88, 204; 455/566, 426, 556, 557; 379/88.13, 88.17, 900

(56) References Cited

U.S. PATENT DOCUMENTS 5,335,276 A * 8/1994 Thompson et al. ..... 380/266
5,742,894 A * 4/1998 Jambhekar et al. ..... 455/90
5,867,140 A * 2/1999 Rader ..... 345/98
6,009,336 A * 12/1999 Harris et al. ..... 455/566
6,097,352 A * 8/2000 Zavracky et al. ..... 345/7
6,115,618 A * 9/2000 Lebby et al. ..... 455/566
6,243,596 B1 * 6/2001 Kikinis ..... 455/572
6,272,332 B1 * 8/2001 Matsumoto et al. ..... 455/412

OTHER PUBLICATIONS

Microsoft Press Computer Dictionary, Copyright 1994, p. 265.*

* cited by examiner

*Primary Examiner*—Bipin Shalwala
*Assistant Examiner*—Ricardo Osorio
(74) *Attorney, Agent, or Firm*—Dilworth & Barrese, LLP

(57) ABSTRACT

There is provided a color LCD (Liquid Crystal Display) interface circuit for outputting an RGB (Red, Green, Blue) signal for an intended image and a synchronization signal for either a horizontal and vertical synchronization or a composite synchronization to a color LCD controller in a portable radio terminal which has a color LCD and a controller and supports a character-type black and white LCD. In the color LCD interface circuit, a first memory stores data needed to execute a color LCD interface program and to represent fonts and color, a main controller reads the color LCD interface program from the first memory and executes the color LCD interface program, a second memory stores a page of image information generated during executing the color LCD interface program, a multiplexer selects one of input signals according to whether a graphical display on the color LCD is a picture or represents the operational status of the portable radio terminal, and a color processor receives various commands and index data from the controller and generates an internal composite synchronization signal and a digital RGB signal.

4 Claims, 1 Drawing Sheet

COLOR LCD INTERFACE CIRCUIT IN A PORTABLE RADIO TERMINAL

BACKGROUND OF THE INVENTION

1. Field of the Invention

The present invention relates generally to a display in a portable radio terminal, and in particular, to an interface circuit of a color LCD (Liquid Crystal Display) for displaying pictures or characters.

2. Description of the Related Art

As the performance of communication terminals (mobile phones) improves, they are capable of transmitting not only voice communication but also data and image communication as well. To provide the image communication service, the standard character-type black and white LCD is replaced with a color LCD. Because of the large power dissipation of an OSD (On Screen Display), the typical television OSD is difficult to apply to a communication terminal (mobile phone) which requires minimum power consumption. A low power consumption alternative, like the LCD, is needed. Unfortunately, the conventional control devices cannot be applied to the color LCD, therefore, a new color LCD interface is needed. While constructing an RGB (Red, Green, Blue) signal and a synchronization circuit represents a significant undertaking, the present invention addresses this problem.

SUMMARY OF THE INVENTION

It is, therefore, an object of the present invention to provide an interface circuit in a portable radio terminal (mobile phone) for interfacing between a color LCD controller and a portable radio terminal controller. The output circuit consists of a signal suitable for a conventional LCD controller or a color LCD. A conventional character-type LCD may therefore be replaced with a color LCD without incident.

To achieve the above, there is provided a color LCD interface circuit for outputting an RGB signal for an intended image and either a synchronization signal for horizontal and vertical synchronization or a composite synchronization signal to a color LCD controller in a portable radio terminal. The interface circuit is compatible with portable radio terminals having either a color LCD and a controller or a character-type black and white LCD. In the color LCD interface circuit, a first memory stores data needed to execute a color LCD interface program and to represent fonts and color. A main controller reads the color LCD interface program from the first memory and executes the color LCD interface program while a second memory stores a page of image information generated during the execution of the color LCD interface program. A multiplexer selects one of the input signals according to whether a graphical display on the color LCD is an image or represents the operational status of the portable radio terminal. A color processor receives various commands and index data from the controller and generates an internal composite synchronization signal and a digital RGB signal.

BRIEF DESCRIPTION OF THE DRAWING

The above and other objects, features and advantages of the present invention will become more apparent from the following detailed description when taken in conjunction with the accompanying drawing in which.

DETAILED DESCRIPTION OF THE PREFERRED EMBODIMENT

Figure 1:
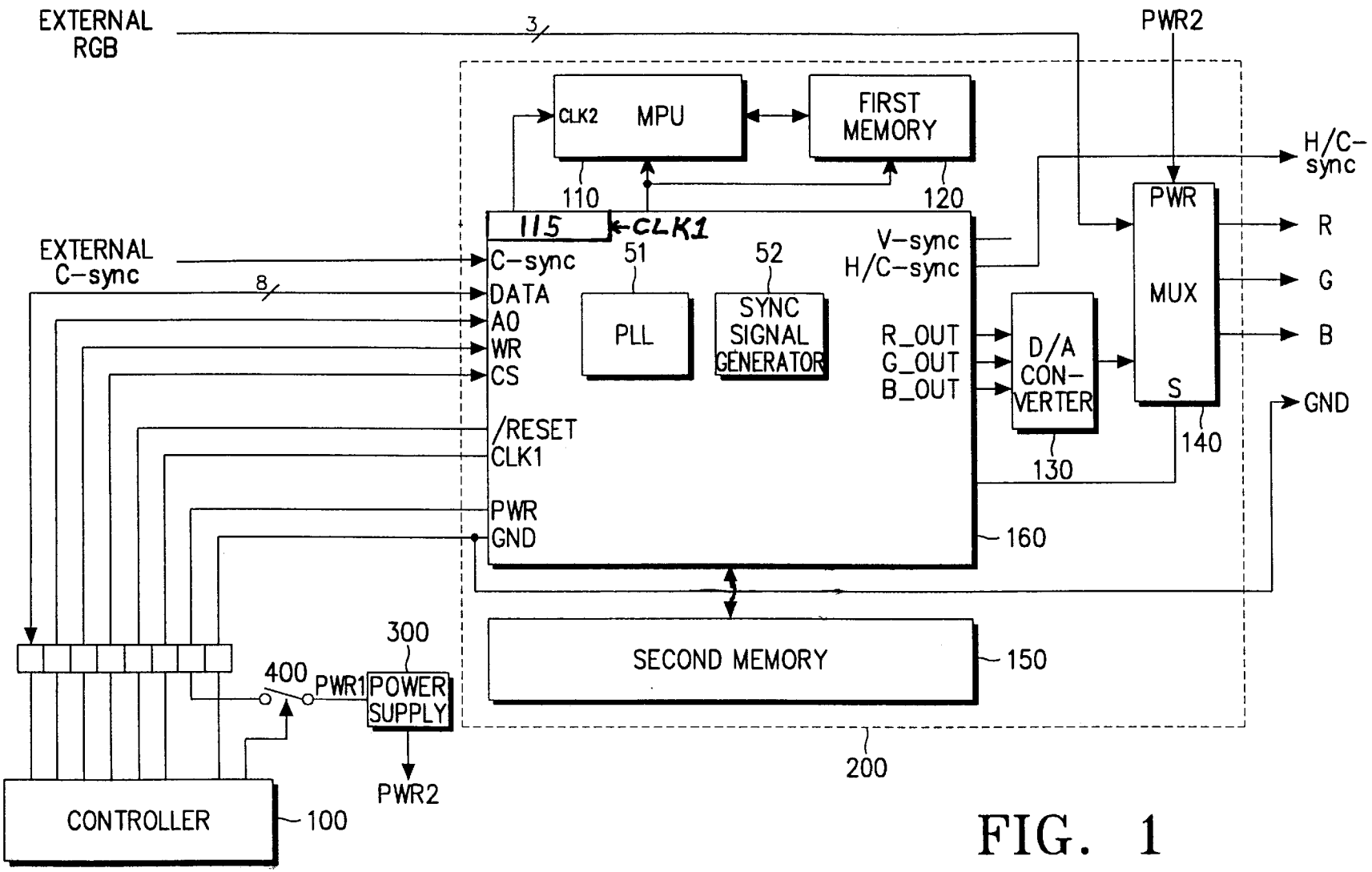
FIG. 1 is a block diagram of a color LCD interface circuit in a portable radio terminal according to an embodiment of the present invention.

A preferred embodiment of the present invention will be described hereinbelow with reference to the accompanying drawings. In the following description, well-known functions or constructions are not described in detail since they would obscure the invention in unnecessary detail.

Referring to FIG. 1, reference numeral 100 denotes a portable radio terminal controller (hereinafter, referred to as a controller), which can be an MSM (Mobile Station MODEM). An LCD interface circuit 200 includes: a microprocessor unit (MPU) 110, a first memory 120, a digital-to-analog (D/A) converter 130, a multiplexer 140, a second memory 150, and a color processor 160. Reference numeral 300 denotes a power supply for supplying power to the LCD interface circuit 200. A switch 400, operating under the control of controller 100, connects the color LCD interface circuit operating voltage (e.g., 3.3.V) from a power supply terminal PWR1 to circuit 200. The multiplexer 140 should operate all the time and therefore receives a DC (Direct Current) voltage (e.g., 3.3V) from the power supply 300 through a power supply terminal PWR2. PWR1 and PWR2 are identical though they are separately described for the sake of convenience.

The color LCD interface circuit 200 generates an RGB signal for an intended image and either a synchronization signal for horizontal synchronization and vertical synchronization, or a composite synchronization signal, and feeds these signals to an LCD controller (not shown).

The first memory 120 can be a ROM and is used to store a color LCD interface program and initial data. The initial data refers to fonts or other data needed for representing 256 colors. It is understood that one skilled in the art may modify the present invention to display more or less colors without departing from the spirit and scope of the present invention. The MPU 110 reads the color LCD interface program from the first memory 120 and executes the program.

The second memory 150 can be a RAM and temporarily stores any data required to implement the color LCD interface program, for example, information about a page of images.

The D/A converter 130 converts the digital RGB output of the color processor 160 to analog data. It is determined whether to output a signal in an analog or digital form depending on the form of an LCD input. In the embodiment of the present invention, the D/A converter 130 is used to output a signal in an analog form. If the LCD requires digital inputs, the D/A converter 130 is not necessary.

The multiplexer 140 selects one of the input signals according to whether a graphical display on the color LCD is an image like a photograph or represents the operational status of the portable radio terminal. That is, the multiplexer 140 selects between the RGB signal from the D/A converter 130 and an external RGB signal.

The color processor 160 outputs a composite synchronization signal C-sync and a digital RGB signal, for the input of 8-bit data DATA, a chip select signal CS, a write signal WR, a busy check signal AO, and a reset signal /RESET which are provided to a conventional character-type black and white LCD controller by the controller 100. The color LCD interface circuit 200 can output a composite synchronization signal C-sync alone or both vertical and horizontal synchronization signals according to the specification of a color LCD. 'H/C-sync' in the drawing indicates that a port can be designed to be shared for outputting a horizontal synchronization signal or a composite synchronization signal C-sync.

A clock divider 115 divides a first clock signal CLK1 received from the controller 100 by a predetermined value, and feeds the divided signal to the MPU 110 as an operational clock (hereinafter, referred to as a second clock signal CLK2). For example, a first clock signal CLK1 of 27 Mhz can be divided by 2, thereby producing a second clock signal CLK2 of 13.5 Mhz.

The color processor 160 includes a phase locked loop (PLL) 51 and a synchronization signal generator 52. The synchronization signal generator 52 generates a vertical synchronization signal and a composite synchronization signal (an internal composite synchronization signal to be distinguished from an external composite synchronization signal for displaying a background). In addition, the C-sync signal refers to a signal containing H-sync and V-sync. A horizontal synchronization signal can be produced by use of the two synchronization signals. The PLL 51 controls the phase of the internal composite synchronization signal to compensate for the phase difference between the internal and external composite synchronization signals.

The operation of the color LCD interface circuit in the portable radio terminal according to the embodiment of the present invention will now be described in detail.

Two cases can be considered: first, displaying only characters in color, and second, displaying characters and a background in color. The former case needs only an external composite synchronization signal, obviating the need for operating the PLL 51.

The following description is confined to the latter case. An external RGB signal and a composite synchronization signal C-sync are input for displaying a background. The controller 100 outputs a predetermined command and index data to the color LCD interface circuit 200 in order to display the intended characters on a color LCD. The MPU 110 of the color LCD interface circuit 200 interprets the command and the index data, reads a corresponding font from the first memory 120, and writes the font in an intended position of the second memory 150. That is, a character desired by a user is written.

Commands received at the color LCD interface circuit 200 from the controller 100 are processed by the MPU 110. The processing of the MPU 110 includes: interpreting a corresponding command and determining which operation to execute, reading the font, character color, and background color from the first memory 120 according to the determination, and constructing a page of images in the second memory 150. The images are then displayed.

In accordance with the present invention as described, a portable radio terminal controller can output a signal suitable for either a conventional character-type black and white LCD display or a color LCD, without any modification, simply by using the interface circuit of the present invention.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A color LCD (Liquid Crystal Display) interface circuit for outputting an RGB (Red, Green, Blue) signal for an intended image and either a synchronization signal for horizontal and vertical synchronization or a composite synchronization signal to a color LCD controller in a portable radio terminal having a color LCD and a terminal controller, the circuit comprising:

a first memory for storing data needed to execute a color LCD interface program and to represent fonts and color;

a main controller for reading the color LCD interface program from said first memory and executing said color LCD interface program;

a second memory for storing a page of image information generated during the execution of said color LCD interface program;

a color processor for receiving various commands and index data from the terminal controller and generating an internal composite synchronization signal and a digital RGB signal; and a multiplexer for selecting one of the input signals according to whether a graphical display on the color LCD is a picture or represents the operational status of the portable radio terminal, said first input signal being an external RGB signal, and said second input signal being said digital RGB signal generated by said color processor.

2. The color LCD interface circuit of claim 1, further comprising a digital-to-analog converter for converting the digital RGB signal received from the color processor to an analog signal.

3. The color LCD interface circuit of claim 1, wherein the color processor receives a first clock signal from the terminal controller and a clock divider located within the color processor divides the first clock signal by a predetermined value, and outputs the divided signal to the main controller.

4. The color LCD interface circuit of claim 1, wherein the color processor comprises:

a synchronization signal generator for generating the internal composite synchronization signal; and a phase locked loop for controlling the phase of the internal composite synchronization signal to compensate for a phase difference between an external composite synchronization signal and the internal composite synchronization signal.

* * * * *